US010847040B2

(12) United States Patent
Emsbach et al.

(10) Patent No.: US 10,847,040 B2
(45) Date of Patent: Nov. 24, 2020

(54) RESTRICTED AIRSPACE MONITORING SYSTEMS AND METHODS

(71) Applicant: THE BOEING COMPANY, Chicago, IL (US)

(72) Inventors: Theresa Emsbach, Neu-Isenburg (DE); Nils Kneuper, Bergkamen (DE); Ralf Rene Shu-Zhong Cabos, Hainburg (DE); Garoe Gonzalez Parra, Frankfur um Main (DE)

(73) Assignee: THE BOEING COMPANY, Chicago, IL (US)

( * ) Notice: Subject to any disclaimer, the term of this patent is extended or adjusted under 35 U.S.C. 154(b) by 189 days.

(21) Appl. No.: 16/106,253

(22) Filed: Aug. 21, 2018

(65) Prior Publication Data

US 2020/0066163 A1 Feb. 27, 2020

(51) Int. Cl.
*G08G 5/00* (2006.01)

(52) U.S. Cl.
CPC ..... *G08G 5/006* (2013.01); *G08G 5/0008* (2013.01); *G08G 5/0013* (2013.01); *G08G 5/0034* (2013.01); *G08G 5/0039* (2013.01); *G08G 5/0082* (2013.01)

(58) Field of Classification Search
CPC .. G08G 5/0008; G08G 5/0013; G08G 5/0026; G08G 5/0034; G08G 5/0039; G08G 5/006; G08G 5/0082
See application file for complete search history.

(56) References Cited

U.S. PATENT DOCUMENTS

| | | | | |
|---|---|---|---|---|
| 9,424,756 | B2 * | 8/2016 | Gaertner | G08G 5/0021 |
| 2009/0115637 | A1 * | 5/2009 | Naimer | G08G 5/0021 340/979 |
| 2010/0042269 | A1 * | 2/2010 | Kokkeby | G01S 3/7864 701/3 |
| 2011/0202206 | A1 * | 8/2011 | Karthikeyan | G01C 23/00 701/3 |
| 2015/0355832 | A1 * | 12/2015 | Dostal | G08G 5/0021 715/771 |
| 2016/0189549 | A1 | 6/2016 | Marcus | |
| 2017/0076610 | A1 | 3/2017 | Liu | |
| 2017/0270803 | A1 | 9/2017 | High | |
| 2017/0345127 | A1 * | 11/2017 | Gameros | G06T 3/0068 |
| 2018/0130359 | A1 * | 5/2018 | Clark | G06F 16/22 |
| 2018/0218619 | A1 * | 8/2018 | Brown | H04W 12/06 |
| 2020/0105146 | A1 * | 4/2020 | Schwartz | G08G 5/0021 |

OTHER PUBLICATIONS

Extended European Search Report for EP 19192584.1-1203, dated Jan. 30, 2020.
Haude, Christian, "Development of an Analysis System for Deviation Calculation Between Scheduled Flight Plans and Real Flight Trajectories," Master's Thesis, Nov. 1, 2017.

* cited by examiner

*Primary Examiner* — Robert T Nguyen
(74) *Attorney, Agent, or Firm* — The Small Patent Law Group LLC; Joseph M. Butscher

(57) ABSTRACT

A restricted airspace monitoring system and method include a restricted airspace monitoring control unit that is configured to determine if a restricted airspace is active through monitored positions of a plurality of aircraft within an airspace that includes the restricted airspace and/or restriction notice information.

20 Claims, 4 Drawing Sheets

RESTRICTED AIRSPACE MONITORING SYSTEMS AND METHODS

FIELD OF THE DISCLOSURE

Embodiments of the present disclosure generally relate to systems and methods of monitoring restricted airspace, and more particularly to systems and methods of adapting flight plans based on a monitored restricted airspace.

BACKGROUND OF THE DISCLOSURE

Various types of aircraft are used to transport passengers and cargo between various locations. Each aircraft typically flies between different locations according to a defined flight plan or path. For example, a dispatcher may determine a particular flight path for an aircraft between two different locations.

The flight path from a departure location to an arrival location may not be a direct path. For example, a restricted airspace may be located between the departure location and the arrival location. The airspace may be restricted for various reasons, such as military operations or exercises, governmental or political events, sporting events, environmental emergencies (such as forest fires), or the like.

The restricted airspace may be active (i.e., the reason why the airspace is restricted is actually occurring, such as military training exercises) at only certain times during a day. For example, military exercises may occur for an hour in the morning with a three hour break until exercises resume. The restricted airspace may be active for only a few hours during the day, and inactive during the remainder of the day. However, even during periods when the restricted airspace is inactive, flight plans for aircraft typically are detoured around the restricted airspace. The detoured flight path around the restricted airspace increases flight time and fuel costs.

SUMMARY OF THE DISCLOSURE

A need exists for a system and method that monitors restricted airspace to determine whether the restricted airspace is active or inactive. Further, a need exists for a system and method that is able to predict periods of inactivity of the restricted airspace. Moreover, a need exists for a system and method that allows flight plans to be adapted in relation to periods of restricted airspace inactivity, so as to provide a more direct flight path between a departure location and an arrival location, thereby decreasing flight times and/or saving fuel.

With those needs in mind, certain embodiments of the present disclosure provide a restricted airspace monitoring system that includes a restricted airspace monitoring control unit that is configured to determine if a restricted airspace is active through monitored positions of a plurality of aircraft within an airspace that includes the restricted airspace and/or restriction notice information.

The restricted airspace monitoring control unit is configured to determine the positions of the plurality of aircraft within the airspace through position signals that are output by the plurality of aircraft. A tracking sub-system may be configured to track the plurality of aircraft by monitoring the position signals that are output by the plurality of aircraft. The position signals may include automatic dependent surveillance-broadcast (ADS-B) signals.

In at least one embodiment, a restricted airspace database stores restricted airspace data. The restricted airspace monitoring control unit is configured to analyze the restricted airspace data to predict a likelihood that the restricted airspace will be inactive at a particular time.

The restricted airspace monitoring system may also include a flight path determination control unit that is configured to determine an alternate flight path for at least one of the plurality of aircraft. The alternate flight path has at least a portion that passes through the restricted airspace. In at least one embodiment, the flight path determination control unit is configured to generate a first flight path for an aircraft that flies around a restricted airspace, and a second flight path that flies through a restricted airspace with a probability that the restricted airspace will be inactive during the time of flight.

The restriction notice information may include one or more of official governmental notices and messages, aircraft communications, addressing and reporting system (ACARS) messages, notice-to-airmen (NOTAM) messages, and/or the like.

In at least one embodiment, the restricted airspace monitoring control unit is configured to determine that the restricted airspace is inactive (and, as such an air traffic controller may expressly allow a pilot to fly an aircraft therethrough) at a particular time in response to at least one of the plurality of aircraft being within the restricted airspace at the particular time. Conversely, the restricted airspace monitoring control unit may be configured to determine that the restricted airspace is active at a particular time in response to none of the plurality of aircraft being within the restricted airspace at the particular time.

The restricted airspace monitoring control unit may be configured to output a fly-through alert to at least one of the plurality of aircraft or a dispatcher in response to determining that the restricted airspace is inactive.

Certain embodiments of the present disclosure provide a restricted airspace monitoring method that includes monitoring positions of a plurality of aircraft within an airspace that includes a restricted airspace, receiving restriction notice information, and determining, by a restricted airspace monitoring control unit, if the restricted airspace is active through the monitoring and the restriction notice information.

The restricted airspace monitoring method may include storing restricted airspace data in a restricted airspace database, analyzing, by the restricted airspace monitoring control unit, the restricted airspace data, and predicting from the analyzing, by the restricted airspace monitoring control unit, a likelihood that the restricted airspace will be inactive at a particular time.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide a restricted airspace monitoring system and method that are configured to analyze information regarding airspace restrictions. In at least one embodiment, aircraft are tracked through position signals, such as automatic dependent surveillance-broadcast (ADS-B) signals. In at least one other embodiment, the aircraft may be tracked through radar (for example, a tracking sub-system may be or include a radar system). Further, the systems and methods receive restriction notice information, such as broadcasted notices and messages from governmental authorities, aircraft, dispatchers, air traffic controllers, and/or the like regarding restricted airspaces. By analyzing (for example, cross-checking) aircraft flight movements as determined through the position signals of the aircraft and the restriction notice information, the restriction airspace monitoring systems and method determine whether restricted airspaces are active (that is, the restrictions are actually in place at a particular time) or inactive (that is, the restrictions are not actually in place at a particular time). In this manner, flight plans may be adapted based on whether or not the restricted airspace is active or inactive. If the restricted airspace is inactive, a flight plan for an aircraft may be adapted so as to provide a more direct route through a restricted airspace (rather than, for example, around it), thereby saving flight time and fuel.

Embodiments of the present disclosure provide systems and methods of monitoring restricted airspace in real time, and may analyze past and present restricted airspace data to predict future periods of inactivity of a restricted airspace. The systems and methods are able to provide a probabilistic approach to flight planning by checking for airspace use via aircraft position signals to help determine if a restricted area is in use (for example, active) or is free (for example, inactive).

Figure 1:
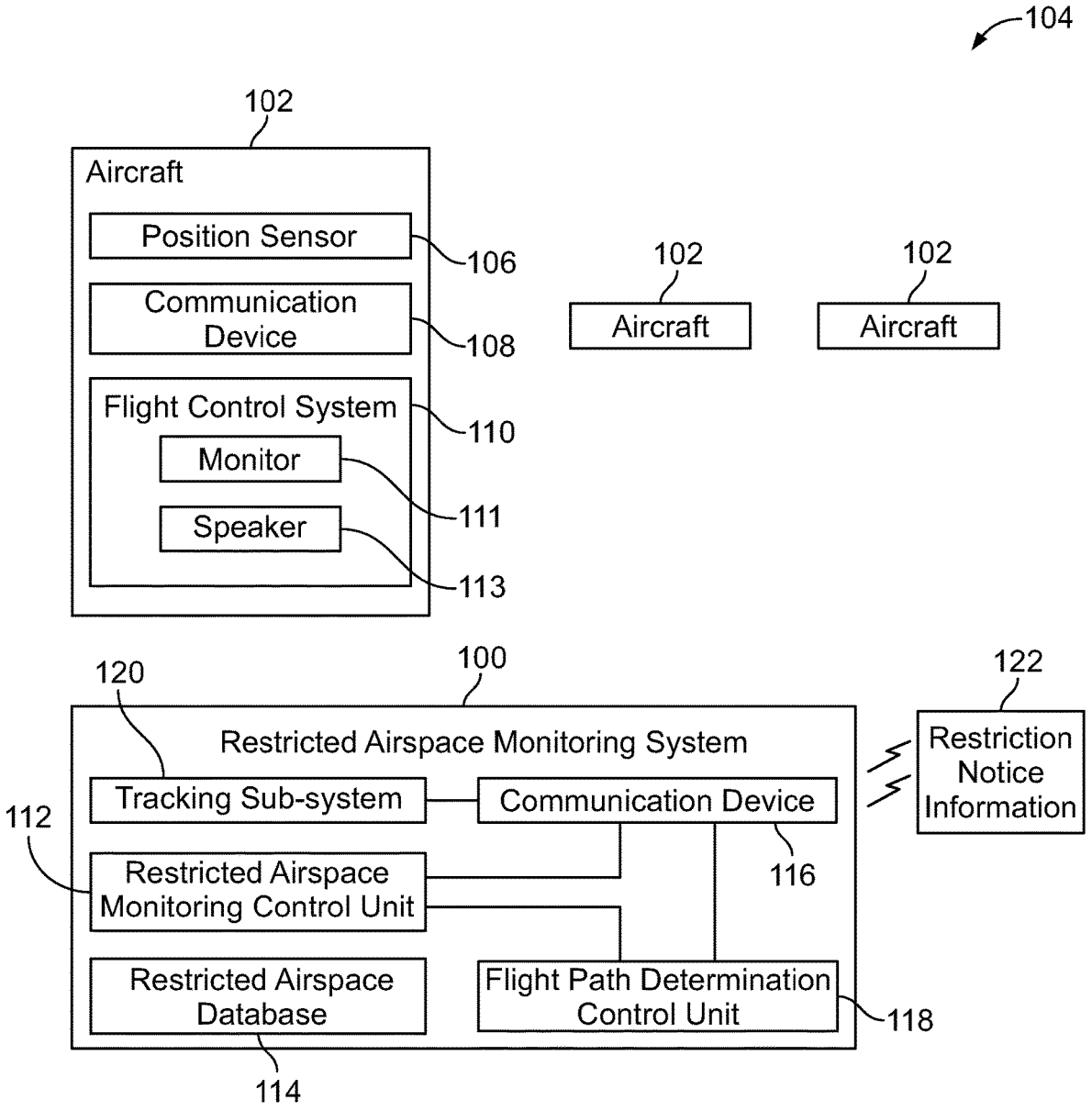
FIG. 1 illustrates a schematic block diagram of a restricted airspace monitoring system and aircraft within an airspace, according to an embodiment of the present disclosure.

FIG. 1 illustrates a schematic block diagram of a restricted airspace monitoring system 100 and aircraft 102 within an airspace 104, according to an embodiment of the present disclosure. Each aircraft 102 flies within the airspace 104 between departure locations and arrival locations. Portions of the airspace 104 may be restricted. When the restricted airspaces are active (that is, restrictions are in place), the aircraft 102 (individually and collectively) are prevented from flying therethrough. When the restricted airspaces are inactive (that is, the restrictions are not in place), pilots of the aircraft 102 may request a fly-through (or direct-through) regarding the restricted airspace.

Each aircraft 102 may include a position sensor 106, such as an ADS-B signal position sensor that allows the aircraft 102 to be tracked through output position signals. The position sensor 106 is configured to detect a current position of the aircraft 102 and output a position signal indicative of the current position of the aircraft 102. The position signal includes one or more position parameters, such as speed, altitude, heading, and the like. The aircraft 102 also includes a communication device 108, such as one or more antennas, radio units, transceivers, receivers, transmitters, and/or the like. Further, the aircraft 102 also includes a flight control system 110, which may include various flight controls, a monitor 111, a speaker 113, and/or the like.

The restricted airspace monitoring system 100 includes a restricted airspace monitoring control unit 112, which may be in communication with a restricted airspace database 114, such as through one or more wired or wireless connections. The restricted airspace monitoring control unit 112 is connected to a communication device 116 (such as one or more antennas, radio units, transceivers, receives, transmitters, and/or the like) through one or more wired or wireless connections. A flight path determination control unit 118 may be in communication with the restricted airspace monitoring control unit 112 and the communication device 116 through one or more wired or wireless connections. Optionally, the flight path determination control unit 118 may be part of the restricted airspace monitoring control unit 112. That is, the restricted airspace monitoring control unit 112 and the flight path determination control unit 118 may be separate and distinct control units, or part of the same control unit.

As described herein, embodiments of the present disclosure provide the restricted airspace monitoring system 100 that includes the restricted airspace monitoring control unit 112 that is configured to determine if a restricted airspace is active by analyzing positions (such as real time current positions and/or past positions at previous times) of the aircraft 102 within the airspace 104 that includes the restricted airspace and restriction notice information 122. The restricted airspace database 114 stores restricted airspace data (which includes information regarding previous flight paths through the restricted airspace at prior times). The restricted airspace monitoring control unit 112 analyzes the restricted airspace data to predict a likelihood that the restricted airspace is active. For example, based on analysis of the restricted airspace data, the restricted airspace monitoring control unit 112 may provide a predicted likelihood (for example, a greater than X % chance) that the restricted airspace is inactive at a particular time of the day. In at least one embodiment, the restricted airspace monitoring control unit 112 is configured to determine that the restricted airspace is inactive at a particular time in response to detecting at least one of the aircraft 102 within the restricted airspace at the particular time. Conversely, the restricted airspace monitoring control unit may be configured to determine that the restricted airspace is active at a particular time in response to detecting none of the aircraft within the restricted airspace at the particular time.

The restricted airspace monitoring system 100 may also include a tracking sub-system 120 that is configured to track movement of the aircraft 102 within the airspace 104. For example, the tracking sub-system 120 may be an ADS-B tracking sub-system that is configured to track movement of the aircraft 102 through ADS-B signals output by the position sensors 106 of the aircraft 102. The tracking sub-system 120 may be connected to the communication device 116, such as through one or more wired or wireless connections. In at least one other embodiment, the restricted airspace monitoring system 100 may not include the tracking sub-system 120. Instead, the tracking sub-system 120 may be separate and distinct from the restricted airspace monitoring system 100, and in communication with the restricted airspace monitoring system 100.

The restricted airspace monitoring system 100 may be a land-based monitoring system at a particular location. For example, the restricted airspace monitoring system 100 may be located at an airport, such as at an air operation center or air traffic control center. The restricted airspace monitoring system 100 may be configured to monitor the airspace 104 and restricted areas therein. The airspace 104 may cover a particular area in relation to the restricted airspace monitoring system 100. For example, the airspace 104 may be over a defined region, such as within a 500 miles radius from the restricted airspace monitoring system 100. Optionally, the airspace 104 may be over a smaller or larger area than within a 500 miles radius from the restricted airspace monitoring system 100. As an example, the airspace 104 may be over an entire state, region, country, hemisphere or even over an entire surface of the Earth. In at least one other embodiment, the restricted airspace monitoring system 100 may be onboard watercraft, aircraft, spacecraft, a geosynchronous or non-geosynchronous satellite, or the like.

The communication device 116 of the restricted airspace monitoring system 100 is configured to receive the position signals output by the position sensors 106 of the aircraft 102, as well as restriction notice information 122. The restriction notice information 122 may be audio, video, text, or other such signals that are broadcast or output by entities (such as government authorities) regarding restricted airspace. The restriction notice information 122 may include official governmental notices and messages, aircraft communications, addressing and reporting system (ACARS) messages, notice-to-airmen (NOTAM) messages, and/or the like. The restriction notice information 122 may also include signals output by other aircraft 102.

In operation, the restricted airspace monitoring system 100 receives restriction notice information 122 via the communication device 116. The restriction notice information 122 indicates restricted airspace(s) within the airspace 104. The restricted airspace monitoring control unit 112 determines the restricted airspace via the restriction notice information 122 and/or other data already received and stored within the restricted airspace database 114.

The tracking sub-system 120 tracks the aircraft 102 within the airspace 104 via the position signals (for example, ADS-B signals) output by the position sensors 106 of the aircraft 102. The restricted airspace monitoring control unit 112 monitors the actual positions of the aircraft 102 within the airspace 104 via the position signals output by the position sensors 106, as tracked via the tracking sub-system 120. The restricted airspace monitoring control unit 112 compares the tracked positions of the aircraft 102 within the airspace 104 with the locations of restricted airspace, as stored in the restricted airspace database 114 and/or received via the restriction notice information 122. If no aircraft 102 are detected within the restricted airspace(s), the restricted airspace monitoring control unit 112 refrains from outputting potential fly-through alerts to the aircraft 102. If, however, the restricted airspace monitoring control unit 112 determines that certain aircraft 102 are flying through the restricted airspace (such as after a pilot has requested a fly-through of the restricted airspace and been granted the fly-through), the restricted airspace monitoring control unit 112 outputs a potential fly-through alert to the aircraft 102 via the communication device 116. The aircraft 102 receives the potential fly-through alert via the communication device 108, and the potential fly-through alert may be shown on the monitor 111 or broadcast through the speaker 113. After receiving the potential fly-through alert, the pilot may then contact a dispatcher, air traffic controller, and/or the like to request a fly-through of the restricted airspace.

The restricted airspace monitoring control unit 112 analyzes restricted airspace data that is stored on the restricted airspace database 114. For example, restricted airspace data regarding restricted airspace may be stored for a day, a week, a month, a year, or even longer. The restricted airspace monitoring control unit 112 analyzes the restricted airspace data to determine times when the restricted airspace is active or inactive over a particular time period. For example, the restricted airspace monitoring control unit 112 may analyze the restricted airspace data stored in the restricted airspace database 114 and determine that the restricted airspace is generally active for only a certain period of time during a day, and inactive other periods of time during the day, based on an analysis of the restricted airspace data over a period of time (such as a week, month, or year prior to a current time). As such, the restricted airspace monitoring control unit 112 may predict likely periods of inactivity of the restricted airspace at the current time and future time, and provide dispatchers and flight schedulers with potential restricted airspace fly-through opportunities. In this manner, authorities may be contacted and fly-through requests may be made before a flight path or plan is determined. If the fly-through request is granted, the aircraft may not need as much fuel, and may therefore be loaded with less fuel, thereby saving fuel costs and flight time between a departure location and an arrival location.

In at least one embodiment, the flight path determination control unit 118 may automatically generate one or more flight paths for the aircraft 102. The flight path determination control unit 118 may generate a first flight path for an aircraft that flies around a restricted airspace, and a second flight path that flies through a restricted airspace with a probability (such as provided to a dispatcher and/or pilot) that the restricted airspace will be inactive during the time of flight. The probability may be calculated based on analysis of activity/inactivity over a predetermined time frame (such as one or more days, weeks, months, and/or years prior to the current time). The probably may be displayed, such as on the monitor 111. In this manner, a dispatcher or pilot may review both generated flight paths, and request a fly-through of the restricted airspace based on the second flight path. If the fly-through is granted, the dispatcher or pilot may then opt for the second flight path, which reduces flight time and/or saves fuel costs. Alternatively, the restricted airspace monitoring system 100 may not include the flight path determination control unit 118.

As used herein, the term "control unit," "central processing unit," "unit," "CPU," "computer," or the like may include any processor-based or microprocessor-based system including systems using microcontrollers, reduced instruction set computers (RISC), application specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms. For example, the restricted airspace monitoring control unit 112 and the flight path determination control unit 118 may be or include one or more processors that are configured to control operation thereof, as described herein.

The restricted airspace monitoring control unit 112 and the flight path determination control unit 118 are configured to execute a set of instructions that are stored in one or more data storage units or elements (such as one or more memories), in order to process data. For example, the restricted airspace monitoring control unit 112 and the flight path determination control unit 118 may include or be coupled to one or more memories. The data storage units may also store data or other information as desired or needed. The data storage units may be in the form of an information source or a physical memory element within a processing machine.

The set of instructions may include various commands that instruct the restricted airspace monitoring control unit 112 and the flight path determination control unit 118 as a processing machine to perform specific operations such as the methods and processes of the various embodiments of the subject matter described herein. The set of instructions may be in the form of a software program. The software may be in various forms such as system software or application software. Further, the software may be in the form of a collection of separate programs, a program subset within a larger program, or a portion of a program. The software may also include modular programming in the form of object-oriented programming. The processing of input data by the processing machine may be in response to user commands, or in response to results of previous processing, or in response to a request made by another processing machine.

The diagrams of embodiments herein may illustrate one or more control or processing units, such as the restricted airspace monitoring control unit 112 and the flight path determination control unit 118. It is to be understood that the processing or control units may represent circuits, circuitry, or portions thereof that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the restricted airspace monitoring control unit 112 and the flight path determination control unit 118 may represent processing circuitry such as one or more of a field programmable gate array (FPGA), application specific integrated circuit (ASIC), microprocessor(s), and/or the like. The circuits in various embodiments may be configured to execute one or more algorithms to perform functions described herein. The one or more algorithms may include aspects of embodiments disclosed herein, whether or not expressly identified in a flowchart or a method.

As used herein, the terms "software" and "firmware" are interchangeable, and include any computer program stored in a data storage unit (for example, one or more memories) for execution by a computer, including RAM memory, ROM memory, EPROM memory, EEPROM memory, and non-volatile RAM (NVRAM) memory. The above data storage unit types are exemplary only, and are thus not limiting as to the types of memory usable for storage of a computer program.

Figure 2:
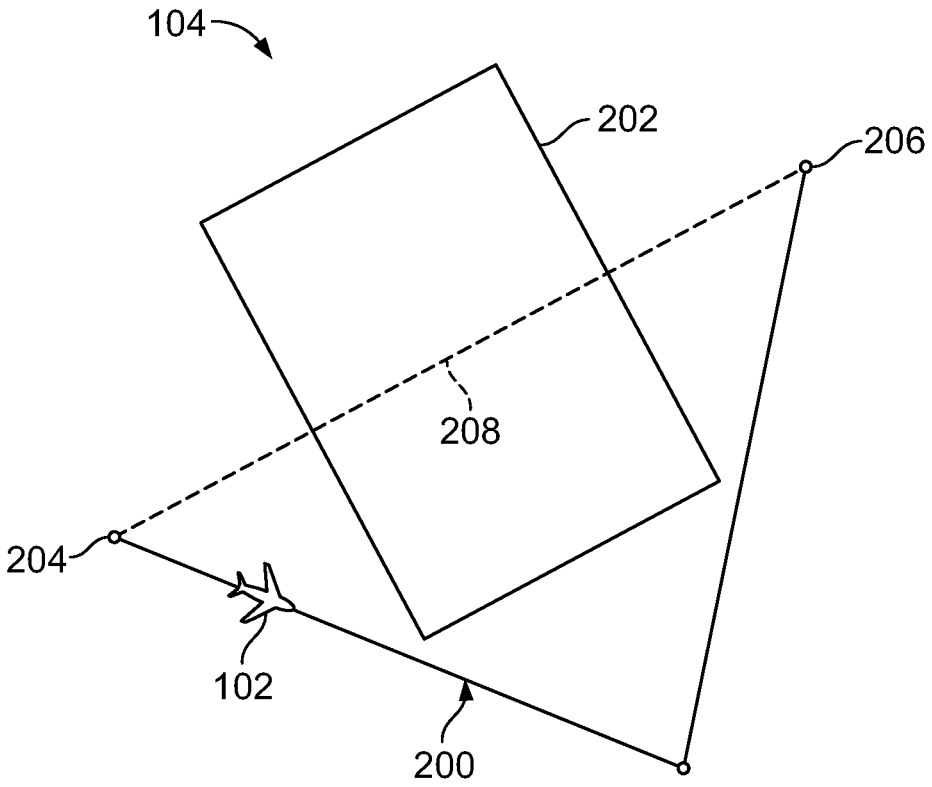
FIG. 2 illustrates a simplified schematic diagram of an aircraft flying according to a first flight path around a restricted airspace, according to an embodiment of the present disclosure.

FIG. 2 illustrates a simplified schematic diagram of an aircraft 102 flying according to a first flight path 200 around a restricted airspace 202, according to an embodiment of the present disclosure. It is to be understood that the first flight path 200 shown is a simplified representation, is not drawn to scale, and is not necessarily indicative of operational capabilities. The restricted airspace 202 is within the airspace 104. The aircraft 102 departs from a departure location 204. The first flight path 200 connects the departure location 204 with an arrival location 206. As shown, a direct second flight path 208 connects the departure location 204 to the arrival location 206. However, the second flight path 208 passes through the restricted airspace 202.

Referring to FIGS. 1 and 2, based on the tracked position data of other aircraft 102 and the restriction notice information 122, the restricted airspace monitoring control unit 112 determines that the restricted airspace 202 is active. As such, the restricted airspace monitoring control unit 112 may output a message to the aircraft 102 that there is not a restricted airspace fly-through possibility at the current time. Accordingly, the aircraft 102 maintains a current course according to the flight path 200 around the restricted airspace 202.

Figure 3:
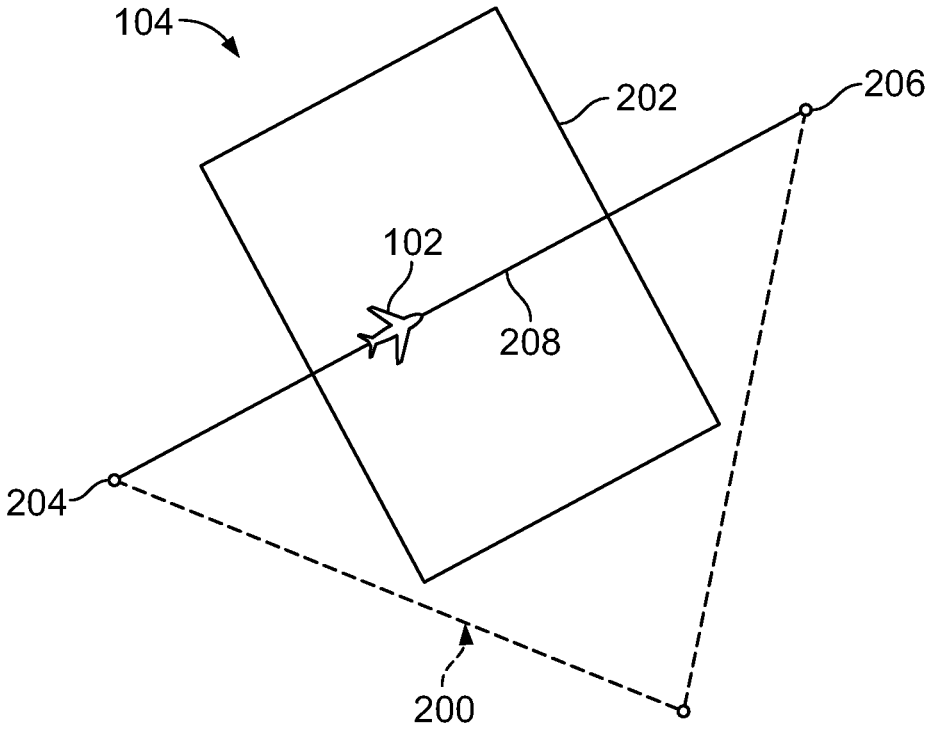
FIG. 3 illustrates a simplified schematic diagram of an aircraft flying according to a second flight path through the restricted airspace, according to an embodiment of the present disclosure.

FIG. 3 illustrates a simplified schematic diagram of the aircraft 102 flying according to the second flight path 208 through the restricted airspace 202, according to an embodiment of the present disclosure. Referring to FIGS. 1 and 2, based on the tracked position data of other aircraft 102 and the restriction notice information 122, the restricted airspace monitoring control unit 112 determines that the restricted airspace 202 is inactive (or is likely inactive). As such, the restricted airspace monitoring control unit 112 may output a potential fly-over message to the aircraft 102 indicating that there may be restricted airspace fly-through possibility at the current time (or at the time at which the aircraft is scheduled to arrive at, or near, the restricted airspace 202). Accordingly, the pilot of the aircraft 102 may then contact the relevant authority to request a fly-through through the restricted airspace 202. The relevant authority may then grant the fly-through request, thereby allowing the aircraft 102 to fly according to the second flight path 208 through the restricted airspace 202. Conversely, if permission to fly through the restricted airspace 202 is not granted, the original flight path that avoids the restricted airspace 202 is followed.

Figure 4:
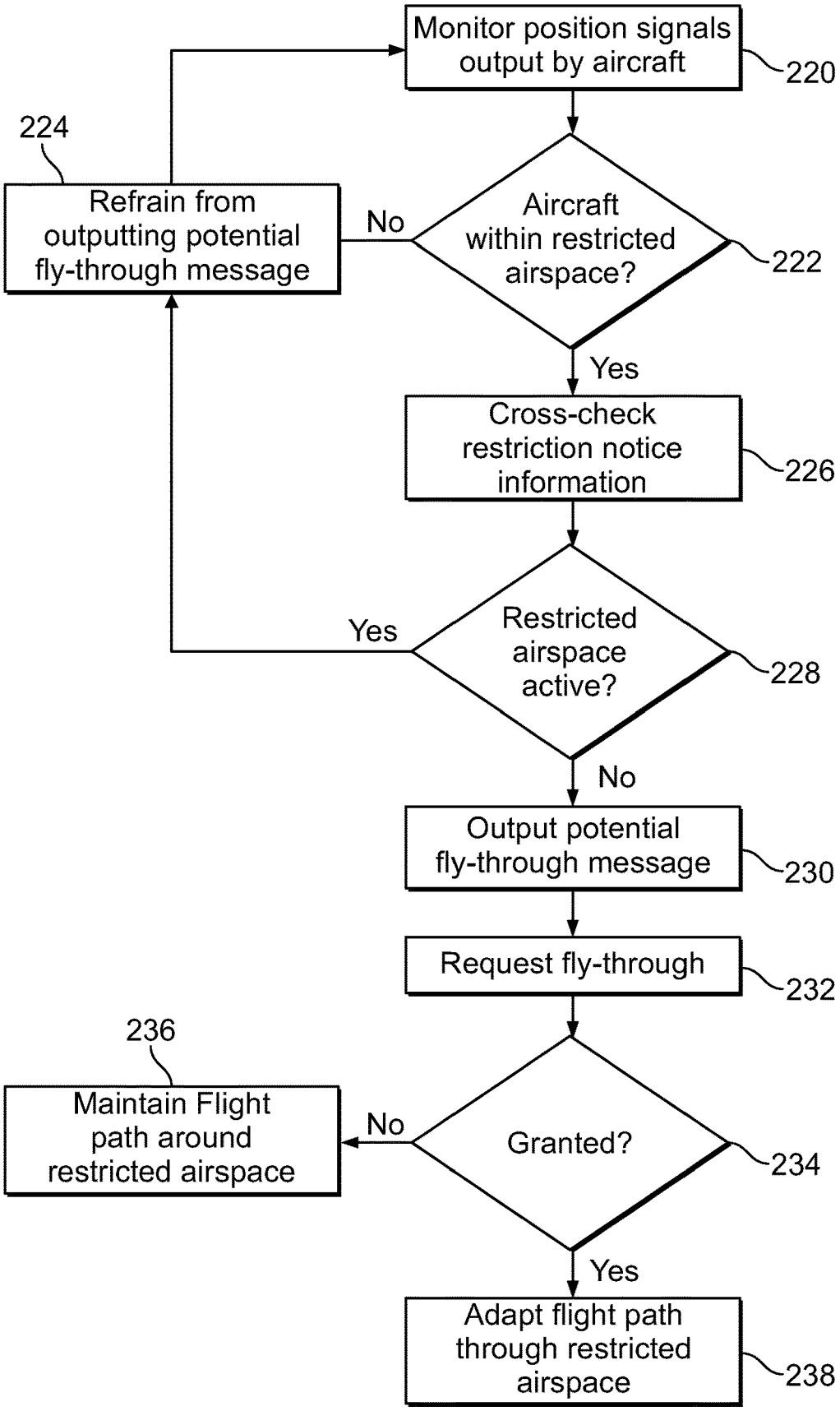
FIG. 4 illustrates a flow chart of a restricted airspace monitoring method, according to an embodiment of the present disclosure.

FIG. 4 illustrates a flow chart of a restricted airspace monitoring method, according to an embodiment of the present disclosure. Referring to FIGS. 1 and 4, position signals (such as ADS-B signals) of aircraft 102 within the airspace 104 are monitored at 220, such as by the restricted airspace monitoring control unit 112 analyzing tracking data output by the tracking sub-system 120. At 222, it is determined whether any aircraft 102 are within a restricted airspace. For example, the restricted airspace monitoring control unit 112 may determine the restricted airspace from restricted airspace data stored in the restricted airspace database 114, and/or through the restriction notice information 122.

If, at 222, it is determined that the aircraft 102 are not within the restricted airspace, the method proceeds to 224, at which the restricted airspace monitoring control unit 112 refrains from outputting a potential fly-through message to the aircraft. The method then returns to 220.

If, however, it is determined that there is at least one aircraft 102 within (or recently within) the restricted airspace at 222, the method proceeds to 226, at which the restricted airspace database cross-checks the restriction notice information 122, so as to determine whether the restricted airspace is active, and if so, for how long. In at least one embodiment, the restricted airspace monitoring control unit 112 may predict whether or not a restricted airspace is currently active based on pattern recognition. For example, if a pattern of military operations in the restricted airspace indicate that the restricted airspace is only active for two hours from a starting time, the restricted airspace monitoring control unit 112 may indicate that there is a likelihood that the restricted airspace will be inactive three or more hours from the starting time on a given day.

At 228, if the restricted airspace is active, the method proceeds to 224, at which the restricted airspace monitoring control unit 112 refrains from outputting a potential fly-through message. If, however, at 228, it is determined that the restricted airspace is inactive, the method proceeds to 230, at which the restricted airspace monitoring control unit 112 outputs a potential fly-through message to the aircraft 102. The potential fly-through message may include an alternate flight path that passes through a portion of the restricted airspace.

After receiving the potential fly-through message from the restricted airspace monitoring control unit 112, a pilot and/or a dispatcher requests a fly-through (of the restricted airspace) at 232. At 234, if the fly-through request is not granted (such as by an air traffic controller or other relevant authority), the method proceeds to 236, at which the aircraft 102 maintains course on the flight path around the restricted airspace. If, however, the fly-through request is granted at 234, the method proceeds to 238, at which the flight path is adapted to pass through the restricted airspace.

As described herein, a restricted airspace monitoring method according to at least one embodiment of the present disclosure includes monitoring positions of a plurality of aircraft within an airspace that includes a restricted airspace, receiving restriction notice information, and determining, by the restricted airspace monitoring control unit 112, if the restricted airspace is active through the position of at least one of the plurality of aircraft and the restriction notice information.

Figure 5:
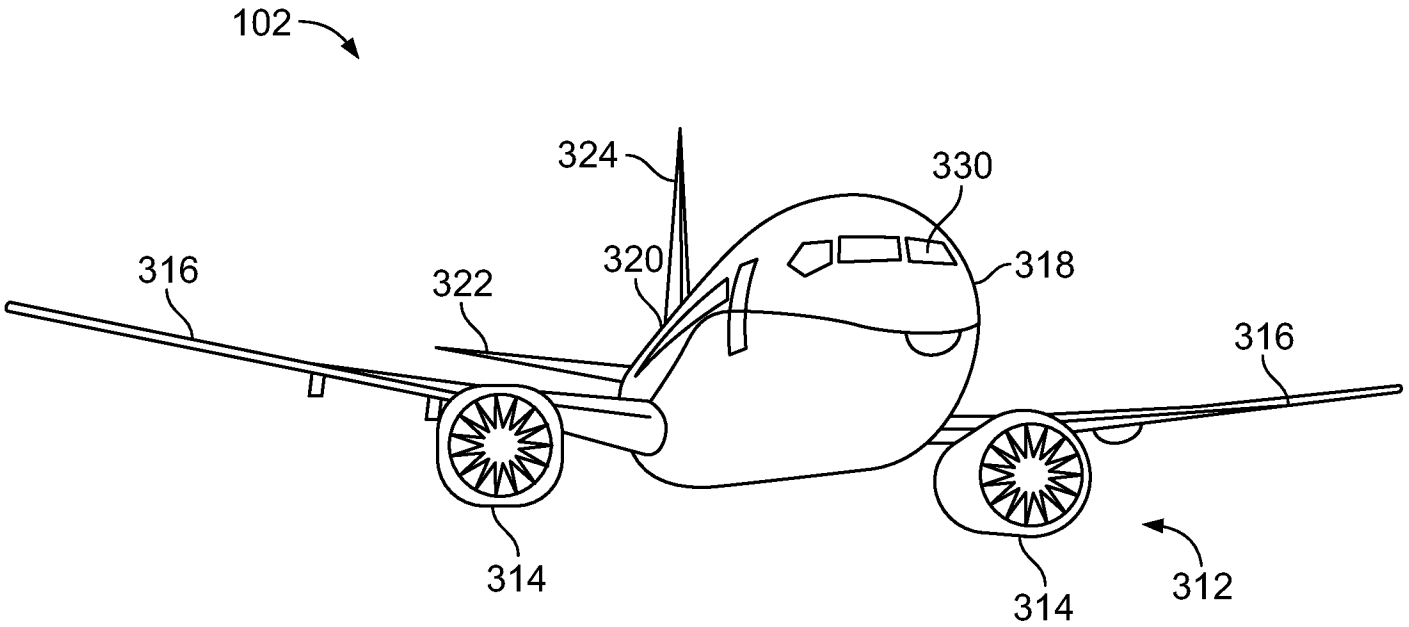
FIG. 5 illustrates a front perspective view of an aircraft, according to an exemplary embodiment of the present disclosure.

FIG. 5 illustrates a front perspective view of an aircraft 102, according to an exemplary embodiment of the present disclosure. The aircraft 102 includes a propulsion system 312 that may include two turbofan engines 314, for example. Optionally, the propulsion system 312 may include more engines 314 than shown. The engines 314 are carried by wings 316 of the aircraft 102. In other embodiments, the engines 314 may be carried by a fuselage 318 and/or an empennage 320. The empennage 320 may also support horizontal stabilizers 322 and a vertical stabilizer 324. The fuselage 318 of the aircraft 102 defines an internal cabin, which may include a cockpit 330, one or more work sections (for example, galleys, personnel carry-on baggage areas, and the like), one or more passenger sections (for example, first class, business class, and coach sections), and an aft section in which an aft rest area assembly may be positioned.

The aircraft 102 may be sized, shaped, and configured other than shown in FIG. 5. For example, the aircraft 102 may be a non-fixed wing aircraft, such as a helicopter. As another example, the aircraft 102 may be an unmanned aerial vehicle (UAV).

Referring to FIGS. 1-5, embodiments of the present disclosure provide systems and methods that allow large amounts of data to be quickly and efficiently analyzed by a computing device. For example, numerous aircraft 102 may be scheduled to fly within the airspace 104. As such, large amounts of data are being tracked and analyzed. The vast amounts of data are efficiently organized and/or analyzed by the restricted airspace monitoring control unit 112, as described herein. The restricted airspace monitoring control unit 112 analyzes the data in a relatively short time in order to quickly and efficiently output and/or display information regarding restricted airspaces within the overall airspace 104. For example, the restricted airspace monitoring control unit 112 analyzes current locations of the aircraft 102 received therefrom in real or near real time to determine locations of the aircraft 102 within the airspace 104, as well as compare the locations of the aircraft 102 to restricted airspace(s), as stored in the restricted airspace database 114, and/or received via the restriction notice information 122. A human being would be incapable of efficiently analyzing such vast amounts of data in such a short time. As such, embodiments of the present disclosure provide increased and efficient functionality with respect to prior computing systems, and vastly superior performance in relation to a human analyzing the vast amounts of data. In short, embodiments of the present disclosure provide systems and methods that analyze thousands, if not millions, of calculations and computations that a human is incapable of efficiently, effectively and accurately managing.

As described herein, embodiments of the present disclosure provide systems and methods that monitor restricted airspace(s) to determine whether the restricted airspace(s) is currently active or inactive. Further, the systems and methods are able to predict periods of inactivity of the restricted airspace(s) (such as based on historical data of the restricted airspace(s), as stored in the restricted airspace database 114). Moreover, the systems and methods allow flight plans to be adapted in relation to periods of restricted airspace inactivity so as to provide a more direct flight path between a departure location and arrival location, thereby leading to shorter flight times and/or fuel savings.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. A restricted airspace monitoring method, comprising:

monitoring positions of a plurality of aircraft within an airspace that includes a restricted airspace, wherein the monitoring comprises determining the positions of the plurality of aircraft within the airspace through automatic dependent surveillance-broadcast (ADS-B) signals that are output by the plurality of aircraft;

receiving restriction notice information; and determining, by a restricted airspace monitoring control unit, if the restricted airspace is active through the monitoring and the restriction notice information.

2. The restricted airspace monitoring method of claim 1, wherein the monitoring further comprises using a tracking sub-system to track the plurality of aircraft.

3. The restricted airspace monitoring method of claim 1, further comprising:

storing restricted airspace data in a restricted airspace database;

analyzing, by the restricted airspace monitoring control unit, the restricted airspace data; and predicting from the analyzing, by the restricted airspace monitoring control unit, a likelihood that the restricted airspace will be inactive at a particular time.

4. The restricted airspace monitoring method of claim 1, further comprising determining, by a flight path determination control unit, an alternate flight path for at least one of the plurality of aircraft, wherein the alternate flight path has at least a portion that passes through the restricted airspace.

5. The restricted airspace monitoring method of claim 4, wherein the determining, by the flight path determination control unit, comprises generating a first flight path for an aircraft that flies around a restricted airspace, and a second flight path that flies through the restricted airspace with a probability that the restricted airspace will be inactive during the time of flight.

6. The restricted airspace monitoring method of claim 1, wherein the determining, by the restricted airspace monitoring control unit, comprises determining that the restricted airspace is inactive at a particular time in response to at least one of the plurality of aircraft being within the restricted airspace at the particular time.

7. The restricted airspace monitoring method of claim 1, wherein the determining, by the restricted airspace monitoring control unit, comprises determining that the restricted airspace is active at a particular time in response to none of the plurality of aircraft being within the restricted airspace at the particular time.

8. The restricted airspace monitoring method of claim 1, further comprising outputting, by the restricted airspace monitoring control unit, a fly-through alert to at least one of the plurality of aircraft or a dispatcher in response to determining that the restricted airspace is inactive.

9. A restricted airspace monitoring system, comprising:

a tracking sub-system configured to track a plurality of aircraft by monitoring automatic dependent surveillance-broadcast (ADS-B) signals that are output by the plurality of aircraft; and a restricted airspace monitoring control unit configured to determine positions of the plurality of aircraft within an airspace through the ADS-B signals, and determine if a restricted airspace is active through the positions of the plurality of aircraft within the airspace that includes the restricted airspace.

10. The restricted airspace monitoring system of claim 9, further comprising a restricted airspace database that stores restricted airspace data, wherein the restricted airspace monitoring control unit is configured to analyze the restricted airspace data to predict a likelihood that the restricted airspace will be inactive at a particular time.

11. The restricted airspace monitoring system of claim 9, further comprising a flight path determination control unit configured to determine an alternate flight path for at least one of the plurality of aircraft, wherein the alternate flight path has at least a portion that passes through the restricted airspace.

12. The restricted airspace monitoring system of claim 11, wherein the flight path determination control unit is configured to generate a first flight path for an aircraft that flies around a restricted airspace, and a second flight path that flies through the restricted airspace with a probability that the restricted airspace will be inactive during a time of flight.

13. The restricted airspace monitoring system of claim 9, wherein the restricted airspace monitoring control unit is further configured to determine if the restricted airspace is active through restriction notice information that comprises one or more of official governmental notices and messages, aircraft communications, addressing and reporting system (ACARS) messages, or notice-to-airmen (NOTAM) messages.

14. The restricted airspace monitoring system of claim 9, wherein the restricted airspace monitoring control unit is configured to determine that the restricted airspace is inactive at a particular time in response to at least one of the plurality of aircraft being within the restricted airspace at the particular time.

15. The restricted airspace monitoring system of claim 9, wherein the restricted airspace monitoring control unit is configured to determine that the restricted airspace is active at a particular time in response to none of the plurality of aircraft being within the restricted airspace at the particular time.

16. The restricted airspace monitoring system of claim 9, wherein the restricted airspace monitoring control unit is configured to output a fly-through alert to at least one of the plurality of aircraft or a dispatcher in response to determining that the restricted airspace is inactive.

17. The restricted airspace monitoring system of claim 9, wherein one or both of the tracking sub-system or the restricted airspace monitoring control unit is land-based.

18. The restricted airspace monitoring system of claim 9, wherein one or both of the tracking sub-system or the restricted airspace monitoring control unit is onboard a watercraft, an aircraft, a spacecraft, a geosynchronous satellite or a non-geosynchronous satellite.

19. A restricted airspace monitoring system, comprising:

a tracking sub-system configured to track a plurality of aircraft by monitoring automatic dependent surveillance-broadcast (ADS-B) signals that are output by the plurality of aircraft;

a restricted airspace database that stores restricted airspace data;

a restricted airspace monitoring control unit configured to determine positions of the plurality of aircraft within an airspace through the ADS-B signals, determine if a restricted airspace is active through the positions of the plurality of aircraft within the airspace that includes the restricted airspace, and analyze the restricted airspace data to predict a likelihood that the restricted airspace will be inactive at a particular time; and a flight path determination control unit configured to determine an alternate flight path for at least one of the plurality of aircraft, wherein the alternate flight path has at least a portion that passes through the restricted airspace.

20. The restricted airspace monitoring system of claim 19, wherein the restricted airspace monitoring control unit is further configured to determine if the restricted airspace is active through restriction notice information that comprises one or more of official governmental notices and messages, aircraft communications, addressing and reporting system (ACARS) messages, or notice-to-airmen (NOTAM) messages.

* * * * *